US009126324B2

(12) United States Patent
Hunkele

(10) Patent No.: US 9,126,324 B2
(45) Date of Patent: Sep. 8, 2015

(54) KNIFE WITH ERGONOMIC HANDLE

(71) Applicant: Peter Gerard Hunkele, Ashland, OR (US)

(72) Inventor: Peter Gerard Hunkele, Ashland, OR (US)

(73) Assignee: LEFTE, LLC, Ashland, OR (US)

( * ) Notice: Subject to any disclaimer, the term of this patent is extended or adjusted under 35 U.S.C. 154(b) by 128 days.

(21) Appl. No.: 14/073,642

(22) Filed: Nov. 6, 2013

(65) Prior Publication Data

US 2015/0151426 A1 Jun. 4, 2015

(51) Int. Cl.

| | |
|---|---|
| ***B26B 3/03*** | (2006.01) |
| ***B25G 1/10*** | (2006.01) |
| ***B26B 9/00*** | (2006.01) |
| ***B26B 9/02*** | (2006.01) |
| ***B26B 27/00*** | (2006.01) |

(52) U.S. Cl.
CPC . *B25G 1/102* (2013.01); *B26B 3/03* (2013.01); *B26B 9/00* (2013.01); *B26B 9/02* (2013.01); *B26B 27/007* (2013.01)

(58) Field of Classification Search
CPC ..... B26B 3/03; B26B 9/00; B26B 9/02; B26B 27/007; B25G 1/02
USPC ..... 30/314
See application file for complete search history.

(56) References Cited

U.S. PATENT DOCUMENTS

| | | | | | |
|---|---|---|---|---|---|
| 244,252 | A | * | 7/1881 | Joyce | 30/298 |
| 251,150 | A | * | 12/1881 | Wilson | 30/343 |
| 495,110 | A | * | 4/1893 | Hayes et al. | 30/355 |
| 1,135,987 | A | * | 4/1915 | Beecher | 30/26 |
| 1,378,551 | A | * | 5/1921 | Miller | 30/293 |
| 2,338,007 | A | | 12/1943 | Morris | |
| 2,359,098 | A | | 9/1944 | Engle | |
| 2,382,304 | A | * | 8/1945 | Foltz et al. | 30/343 |
| 2,685,131 | A | * | 8/1954 | Seeberger | 30/355 |
| D207,386 | S | * | 4/1967 | Laughlin | D7/650 |
| 4,087,911 | A | | 5/1978 | Schrock et al. | |
| D249,453 | S | * | 9/1978 | Covey | D8/97 |
| D266,735 | S | * | 11/1982 | Hahn | D7/650 |
| D330,405 | S | | 10/1992 | Luchak | |
| 5,297,345 | A | | 3/1994 | Jaakola | |
| 5,572,794 | A | * | 11/1996 | Kalbern | 30/353 |
| D405,677 | S | | 2/1999 | Mosley | |
| D439,806 | S | | 4/2001 | Juhlin et al. | |
| 6,502,314 | B1 | * | 1/2003 | McCatty | 30/340 |
| D483,639 | S | | 12/2003 | Jiminez | |
| D523,722 | S | | 6/2006 | Welsh | |
| D525,088 | S | | 7/2006 | Fort et al. | |
| D545,637 | S | | 7/2007 | Curtin | |
| D573,850 | S | * | 7/2008 | Curtin | D7/649 |
| D600,506 | S | * | 9/2009 | Miltner et al. | D7/649 |
| D626,794 | S | * | 11/2010 | Hollinger | D7/650 |
| D642,873 | S | * | 8/2011 | Spiegel | D7/650 |
| D654,325 | S | * | 2/2012 | Ono et al. | D7/649 |
| D684,031 | S | | 6/2013 | Block et al. | |
| 2004/0231475 | A1 | * | 11/2004 | Cornfield et al. | 83/13 |

(Continued)

FOREIGN PATENT DOCUMENTS

| | | | |
|---|---|---|---|
| JP | 2003-26193 | * | 1/2003 |
| KR | 20-2013-0001908 | | 3/2013 |

*Primary Examiner* — Hwei C Payer
(74) *Attorney, Agent, or Firm* — Jerry Haynes Law

(57) ABSTRACT

A knife includes a knife blade and an ergonomic knife handle carried by the knife blade, the ergonomic knife handle including a knife handle frame having at least one finger opening sized and configured to accommodate at least one finger of a user.

17 Claims, 1 Drawing Sheet

(56) References Cited

U.S. PATENT DOCUMENTS

2005/0115084 A1* 6/2005 Hasegawa ..... 30/355
2006/0117576 A1* 6/2006 Demers et al. ..... 30/340
2006/0207110 A1* 9/2006 Nishigaki et al. ..... 30/350
2009/0255561 A1* 10/2009 Brown ..... 135/66
2013/0043693 A1* 2/2013 Chen et al. ..... 294/25
2015/0151426 A1* 6/2015 Hunkele

* cited by examiner

KNIFE WITH ERGONOMIC HANDLE

FIELD OF THE INVENTION

Illustrative embodiments of the disclosure generally relate to knives. More particularly, illustrative embodiments of the disclosure relate to a knife having an ergonomic handle which minimizes wrist strain in a user.

BACKGROUND OF THE INVENTION

Knives which are used to cut cakes and other foods typically include an elongated handle and a knife blade which extends from the handle. In use of the knife, a user grips the handle by wrapping his or her fingers around the handle. In executing the cutting motion, however, it may be necessary for the user to bend the angle of the wrist in such a manner that the wrist may be strained.

Accordingly, a knife having an ergonomic handle which minimizes wrist strain in a user is desirable.

SUMMARY

Illustrative embodiments of the disclosure are generally directed to a knife having an ergonomic handle which minimizes wrist strain in a user. An illustrative embodiment of the knife includes a knife blade and an ergonomic knife handle carried by the knife blade, the ergonomic knife handle including a knife handle frame having at least one finger opening sized and configured to accommodate at least one finger of a user.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
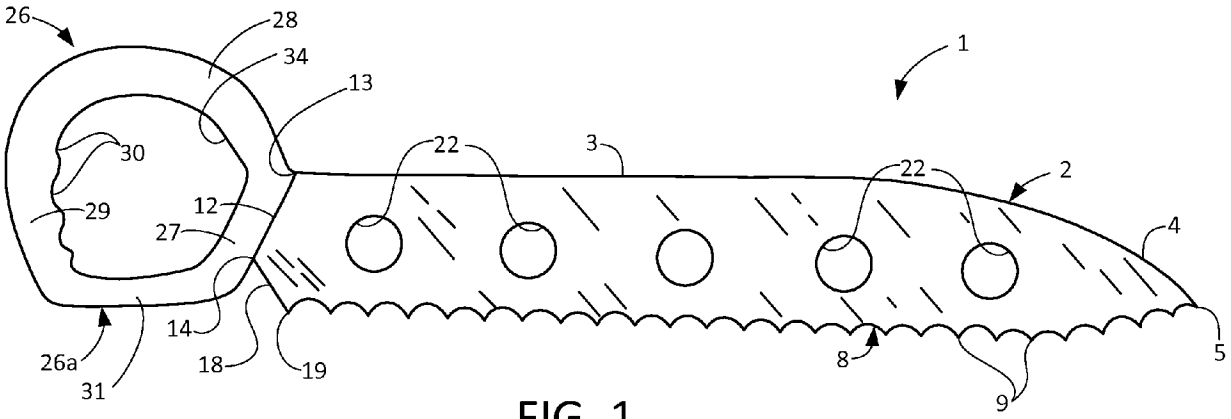
FIG. 1 is a right side view of an illustrative embodiment of the knife with ergonomic handle.
Figure 2:
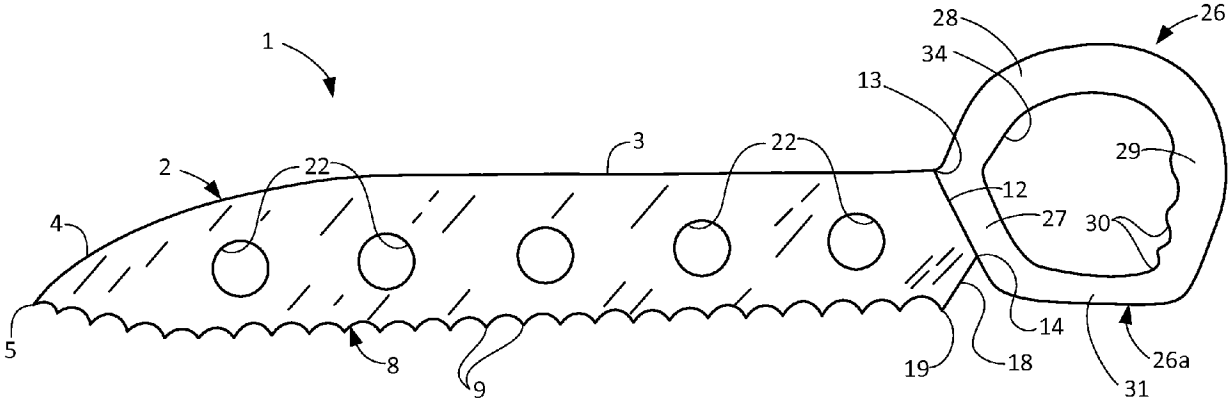
FIG. 2 is a left side view of an illustrative embodiment of the knife with ergonomic handle.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "front", "rear", "upper" and "lower" are for descriptive purposes only and are not to be construed in a limiting sense.

Referring to the drawings, an illustrative embodiment of the knife with ergonomic handle, hereinafter knife, is generally indicated by reference numeral 1. The knife 1 includes a knife blade 2. The knife blade 2 may include ceramic, metal, plastic and/or other material which is consistent with the functional requirements of the knife 1 and may be fabricated in various colors. The knife blade 2 may be generally elongated with a generally straight upper blade edge 3, a generally curved front blade edge 4 which extends forwardly from the upper blade edge 3 and a tapered blade tip 5 which terminates the front blade edge 4. A blade cutting edge 8 extends rearwardly from the blade tip 5 in diverging relationship to the front blade edge 4 and may extend in generally parallel, spaced-apart relationship to the upper blade edge 3. In some embodiments, the blade cutting edge 8 may have blade serrations or scallops 9. In other embodiments, the blade cutting edge 8 may lack the blade serrations or scallops 9. At least one blade openings 22 may extend through the knife blade 2. The blade openings 22 may be spaced apart and uniform in size. Alternatively, blade openings 22 may be of differing sizes and for example increase or decrease in size as they are distributed along knife blade 2.

A straight handle attachment blade edge 12 may extend generally downwardly and rearwardly from the upper blade edge 3 of the knife blade 2 at an upper attachment blade edge end 13. In some embodiments, the handle attachment blade edge 12 may be disposed at an obtuse angle with respect to the upper blade edge 3. An offset blade edge 18 may extend from the handle attachment blade edge 12 at a tapered blade apex 14. The offset blade edge 18 may terminate at a lower offset blade edge end 19 at the rear end of the blade cutting edge 8. In some embodiments, the offset blade edge 18 may be disposed at an obtuse angle with respect to the handle attachment blade edge 12 at the tapered blade apex 14 and at an obtuse angle with respect to the blade cutting edge 8.

An ergonomic knife handle 26 is provided on the knife blade 2. In some embodiments, the ergonomic knife handle 26 may be attached to the knife blade 2 using mechanical fasteners and/or other suitable attachment method or technique known by those skilled in the art. The ergonomic knife handle 26 may include ceramic, metal, plastic and/or other material which is consistent with the functional requirements of the knife 1 and may be fabricated in various colors. In some embodiments, the ergonomic knife handle 26 may be molded, casted and/or otherwise fabricated in one piece with the knife blade 2 according to the knowledge of those skilled in the art.

The ergonomic knife handle 26 may include a knife handle frame **26*a* having at least one finger opening 34 which is sized and configured to accommodate at least one finger (not illustrated) of a user. The knife handle frame 26*a* may include a generally straight and elongated blade attachment handle segment 27 which is attached to the handle attachment blade edge 12 of the knife blade 2 using mechanical fasteners (not illustrated) and/or other suitable attachment technique known by those skilled in the art. A generally elongated, curved and semicircular upper handle segment 28 may extend rearwardly from the blade attachment handle segment 27. A generally elongated rear handle segment 29 may extend downwardly from the upper handle segment 28. A generally elongated and straight lower handle segment 31 may extend between the rear handle segment 29 and the blade attachment handle segment 27. The finger opening 34 may be formed by and between the blade attachment handle segment 27, the upper handle segment 28, the rear handle segment 29 and the lower handle segment 31. At least one finger groove 30 may be provided in the inner surface of the rear handle segment 29 in facing relationship to the finger opening 34**.

In exemplary application, the knife 1 may be used to cut a slice of bread, cake or the like (not illustrated) from a loaf or cake. Accordingly, a user (not illustrated) inserts at least one finger (such as an index finger and a middle finger, for example) through the finger opening 34 of the ergonomic knife handle 26 and grips the rear handle segment 29 with the finger or fingers at the finger groove or grooves 30. One or more additional fingers (not illustrated) may abut against the offset blade edge 18 on the knife blade 2 to maintain the knife blade 2 at a substantially level or horizontal position. The user then places the blade cutting edge 8 of the knife blade 2 against the loaf or cake and moves the knife handle 26 in a downward motion such that the knife blade 2 also moves downwardly and slices through the loaf or cake. The user may repeatedly move the knife 1 in a forward and rearward motion to facilitate ease of the knife blade 2 in cutting through the loaf or cake. It will be appreciated by those skilled in the art that the design of the ergonomic knife handle 26 facilitates ease in movement of the knife blade 2 through the loaf or cake with minimal strain applied to the wrist of the user.

While illustrative embodiments of the disclosure have been described above, it will be recognized and understood that various modifications can be made and the appended claims are intended to cover all such modifications which may fall within the spirit and scope of the disclosure.

What is claimed is:

1. A knife, comprising:

a knife blade having a generally straight upper blade edge, a generally curved front blade edge extending forwardly from the upper blade edge, a tapered blade tip terminating the front blade edge, a blade cutting edge extending rearwardly from the blade tip in diverging relationship to the front blade edge, a straight handle attachment blade edge extending from the upper blade edge at an upper attachment blade edge end, an offset blade edge extending from the handle attachment blade edge at a tapered blade apex and a lower offset blade edge end between the offset blade edge and the blade cutting edge; and an ergonomic knife handle carried by the knife blade, the ergonomic knife handle including a knife handle frame having a blade attachment handle segment attached to the handle attachment blade edge between the tapered blade apex and the upper attachment blade edge end, a generally elongated, curved and semicircular upper handle segment extending from the blade attachment handle segment at the upper attachment blade edge end, a generally elongated rear handle segment extending from the upper handle segment, a generally elongated and straight lower handle segment extending between the rear handle segment and the blade attachment handle segment, and at least one finger opening sized and configured to accommodate at least one finger of a user, and wherein the generally elongated, curved and semicircular upper handle segment extends in a direction away from the generally elongated and straight lower handle segment such that the generally elongated, curved and semicircular upper handle segment extends beyond a line coincided with the generally straight upper blade edge and away from the blade cutting edge.

2. The knife of claim 1 further comprising at least one finger groove in the knife handle frame of the knife handle, the at least one finger groove facing the at least one finger opening.

3. The knife of claim 1 wherein the knife blade comprises ceramic.

4. The knife of claim 1 wherein the blade cutting edge extends in generally parallel, spaced-apart relationship to the upper blade edge.

5. The knife of claim 4 wherein the blade cutting edge comprises a plurality of serrations.

6. The knife of claim 1 further comprising at least one blade opening in the knife blade.

7. A knife, comprising:

a knife blade having a generally straight upper blade edge, a generally curved front blade edge extending forwardly from the upper blade edge, a tapered blade tip terminating the front blade edge, a blade cutting edge extending rearwardly from the blade tip in diverging relationship to the front blade edge, a straight handle attachment blade edge extending from the upper blade edge at an upper attachment blade edge end, an offset blade edge extending from the handle attachment blade edge at a tapered blade apex and a lower offset blade edge end between the offset blade edge and the blade cutting edge; and an ergonomic knife handle carried by the handle attachment blade edge of the knife blade, the ergonomic knife handle including a knife handle frame having:

a straight and elongated blade attachment handle segment carried by the handle attachment blade edge between the tapered blade apex and the upper attachment blade edge end of the knife blade;

a generally elongated, curved and semicircular upper handle segment extending from the blade attachment handle segment at the upper attachment blade edge end;

a generally elongated rear handle segment extending from the upper handle segment;

a generally elongated and straight lower handle segment extending between the rear handle segment and the blade attachment handle segment;

wherein the generally elongated, curved and semicircular upper handle segment extends in a direction away from the generally elongated and straight lower handle segment such that the generally elongated, curved and semicircular upper handle segment extends beyond a line coincided with the generally straight upper blade edge and away from the blade cutting edge; and at least one finger opening sized and configured to accommodate at least one finger of a user.

8. The knife of claim 7 further comprising at least one finger groove in the knife handle frame of the knife handle, the at least one finger groove facing the at least one finger opening.

9. The knife of claim 7 wherein the knife blade comprises ceramic.

10. The knife of claim 7 wherein the blade cutting edge extends in generally parallel, spaced-apart relationship to the upper blade edge.

11. The knife of claim 10 wherein the blade cutting edge comprises a plurality of serrations.

12. The knife of claim 7 further comprising at least one blade opening in the knife blade.

13. The knife of claim 7 wherein the offset blade edge extends at an obtuse angle from the handle attachment blade edge.

14. A knife, comprising:

a knife blade including:

a generally straight upper blade edge;

a generally curved front blade edge extending forwardly from the upper blade edge;

a tapered blade tip terminating the front blade edge;

a blade cutting edge extending rearwardly from the blade tip in diverging relationship to the front blade edge;

a handle attachment blade edge extending from the upper blade edge at an upper attachment blade edge end;

an offset blade edge extending from the handle attachment blade edge to the blade cutting edge;

a tapered blade apex between the handle attachment blade edge and the offset blade edge; and a lower offset blade edge end between the offset blade edge and the blade cutting edge;

an ergonomic knife handle including a knife handle frame having:

a straight and elongated blade attachment handle segment carried by the handle attachment blade edge of the knife blade between the tapered blade apex and the upper attachment blade edge end;

a generally elongated, curved and semicircular upper handle segment extending from the blade attachment handle segment;

a generally elongated rear handle segment extending from the upper handle segment;

a generally elongated and straight lower handle segment extending between the rear handle segment and the blade attachment handle segment;

wherein the generally elongated, curved and semicircular upper handle segment extends in a direction away from the generally elongated and straight lower handle segment such that the generally elongated, curved and semicircular upper handle segment extends beyond a line coincided with the generally straight upper blade edge and away from the blade cutting edge; and at least one finger opening in the knife handle frame, the at least one finger opening sized and configured to accommodate at least one finger of a user.

15. The knife of claim 14 further comprising at least one finger groove in the rear handle segment of the knife handle frame of the knife handle, the at least one finger groove facing the at least one finger opening.

16. The knife of claim 14 wherein the knife blade comprises ceramic.

17. The knife of claim 14 wherein the offset blade edge extends at an obtuse angle from the handle attachment blade edge.

* * * * *